US010339904B1

(12) United States Patent
Antoun

(10) Patent No.: US 10,339,904 B1
(45) Date of Patent: Jul. 2, 2019

(54) VARYING THE NATURAL SOUND OF A DRUM USING A DRUM ATTACHMENT

(71) Applicant: Ramy Antoun, Cedar Park, TX (US)

(72) Inventor: Ramy Antoun, Cedar Park, TX (US)

( * ) Notice: Subject to any disclaimer, the term of this patent is extended or adjusted under 35 U.S.C. 154(b) by 74 days.

(21) Appl. No.: 15/870,762

(22) Filed: Jan. 12, 2018

(51) Int. Cl.
*G10D 13/02* (2006.01)

(52) U.S. Cl.
CPC ..... *G10D 13/021* (2013.01)

(58) Field of Classification Search
CPC ..... G10G 5/005
See application file for complete search history.

(56) References Cited

U.S. PATENT DOCUMENTS 5,877,440 A * 3/1999 Chaffee ..... G10D 13/022 84/411 M
2016/0275924 A1* 9/2016 Hacker ..... G10D 13/025

* cited by examiner

*Primary Examiner* — Kimberly R Lockett

(57) ABSTRACT

Particular embodiments described herein provide for a drum that includes a body, a skin, an attachment point, a support arm that can travel back and forth through the attachment point, and an accessory, wherein when the accessory is positioned on or proximate to the skin, a natural sound of the drum is varied when the drum is struck. In an example, the accessory is removable and can be replaced with a different accessory that will cause a different sound to be produced when the different accessory is positioned on or proximate to the skin and the drum is struck.

20 Claims, 13 Drawing Sheets

VARYING THE NATURAL SOUND OF A DRUM USING A DRUM ATTACHMENT

TECHNICAL FIELD

This disclosure relates in general to the field of music instruments, and more particularly, to varying the natural sound of a drum using a drum attachment.

BACKGROUND

The drum is a member of the percussion group of musical instruments and in the Hornbostel-Sachs classification system, it is considered a membranophone. Generally, drums typically consist of at least one membrane often called a drumhead or drum skin, that is stretched over a shell. The drumhead is struck either directly with the player's hands or with a device to produce sound. Drums are the world's oldest musical instruments and the basic design has remained virtually unchanged for thousands of years.

BRIEF DESCRIPTION OF THE DRAWINGS

To provide a more complete understanding of the present disclosure and features and advantages thereof, reference is made to the following description, taken in conjunction with the accompanying figures, wherein like reference numerals represent like parts, in which.

The FIGURES of the drawings are not necessarily drawn to scale, as their dimensions can be varied considerably without departing from the scope of the present disclosure.

DETAILED DESCRIPTION

Example Embodiments

The following detailed description sets forth examples of apparatuses, methods, and systems relating to a system for enabling, a user to vary the natural sound of a drum using a drum attachment in accordance with an embodiment of the present disclosure. Features such as structure(s), function(s), and/or characteristic(s), for example, are described with reference to one embodiment as a matter of convenience; various embodiments may be implemented with any suitable one or more of the described features.

In the following description, various aspects of the illustrative implementations will be described using terms commonly employed by those skilled in the art to convey the substance of their work to others skilled in the art. However, it will be apparent to those skilled in the art that the embodiments disclosed herein may be practiced with only some of the described aspects. For purposes of explanation, specific numbers, materials and configurations are set forth in order to provide a thorough understanding of the illustrative implementations. However, it will be apparent to one skilled in the art that the embodiments disclosed herein may be practiced without the specific details. In other instances, well-known features are omitted or simplified in order not to obscure the illustrative implementations.

In the following detailed description, reference is made to the accompanying drawings that form a part hereof wherein like numerals designate like parts throughout, and in which is shown, by way of illustration, embodiments that may be practiced. It is to be understood that other embodiments may be utilized and structural or logical changes may be made without departing from the scope of the present disclosure. Therefore, the following detailed description is not to be taken in a limiting sense. For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B, and C).

Figure 1A:
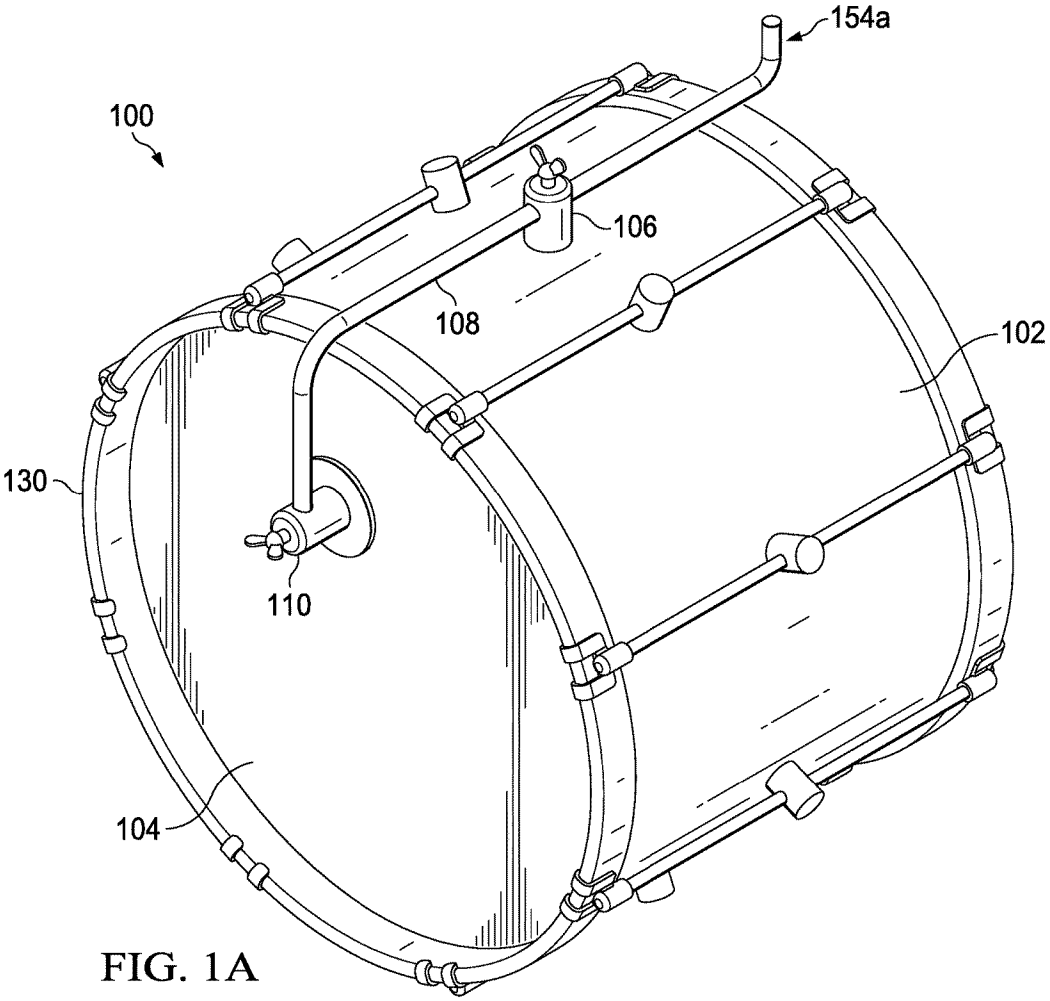
FIG. 1A is a simplified perspective diagram of a drum, in accordance with an embodiment of the present disclosure.

FIG. 1A is a simplified perspective view of a drum 100. Drum 100 can include body 102, skin 104, attachment point 106, support arm 108, accessory attachment mechanism 110, and rim 130. Support arm 108 can include a support arm handle 154*a*. Attachment point 106 can allow support arm 108 to slide back and forth across or over body 102 such that accessory attachment mechanism 110 can move towards and away from skin 104. In an example, support arm handle 154*a* can be grasped by a user to help facilitate the movement of support arm 108 across body 102 and accessory attachment mechanism 110 towards and away from skin 104. Support arm handle 154*a* may have a bend (e.g., a 90-degree bend or around a 90-degree bend) to allow a user to grasp support arm handle 154*a* during the playing of drum 100. Using support arm handle 154*a*, accessory attachment mechanism 110 may be moved and/or positioned towards or away from skin 104 in a relatively short period of time (e.g., one second or less, in one beat, etc.). Drum 100 may be a base drum.

Figure 1B:
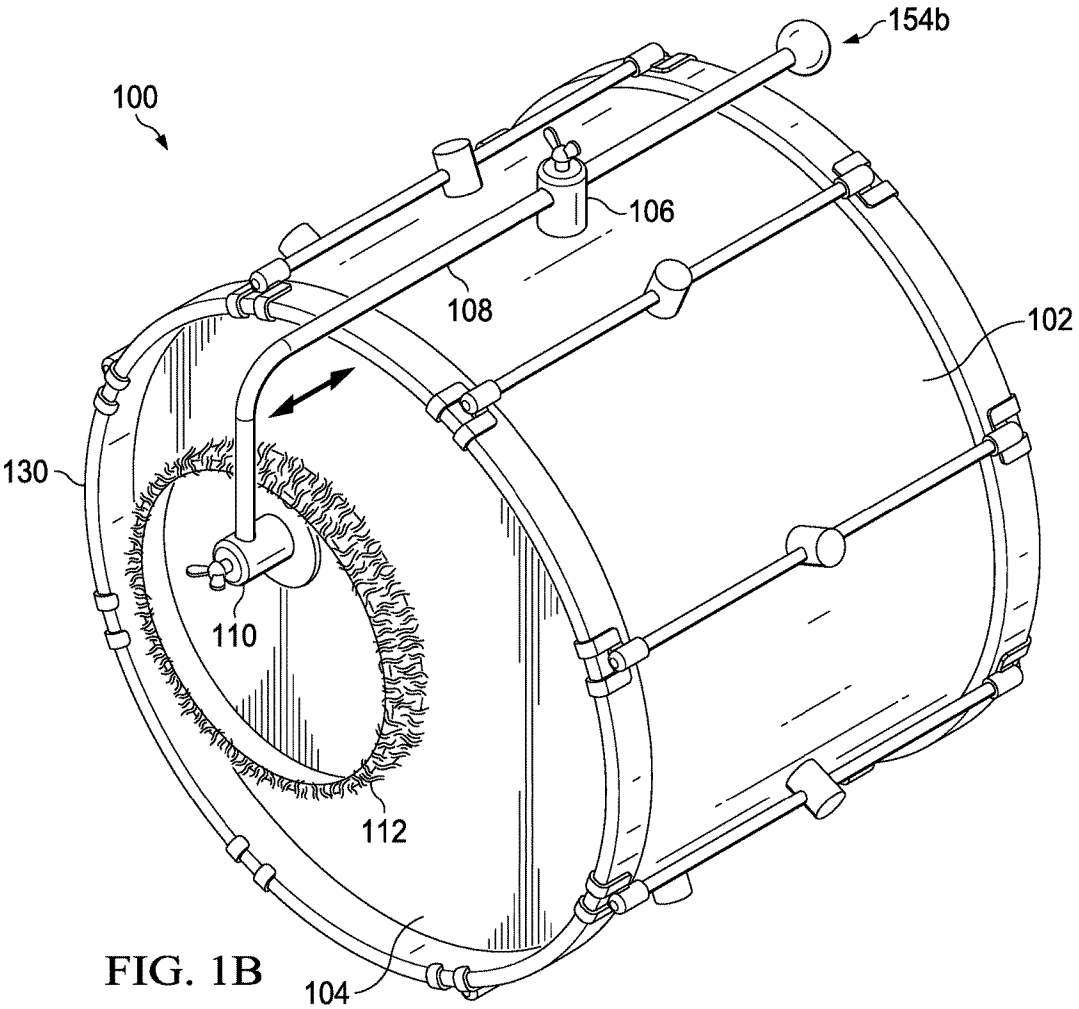
FIG. 1B is a simplified perspective diagram of a drum, in accordance with an embodiment of the present disclosure.

Turning to FIG. 1B, FIG. 1B illustrates an accessory 112 attached to accessory attachment mechanism 110. Accessory 112 may be secured to accessory attachment mechanism 110 by positioning accessory 112 between skin 104 and accessory attachment mechanism 110 and attaching accessory 112 to accessory attachment mechanism 110. Support arm 108 can include a support arm handle 154*b*. In an example, support arm handle 154*b* can be grasped by a user to help facilitate the movement of support arm 108 across body 102 and accessory attachment mechanism 110 towards and away from skin 104. Support arm handle 154*b* may have a rounded or spherical shaped profile to allow a user to grasp support arm handle 154*b* during the playing of drum 100. Using support arm handle 154*b*, accessory attachment mechanism 110 may be moved and/or positioned towards or away from skin 104 in a relatively short period of time (e.g., one second or less, in one beat, etc.).

Figure 1C:
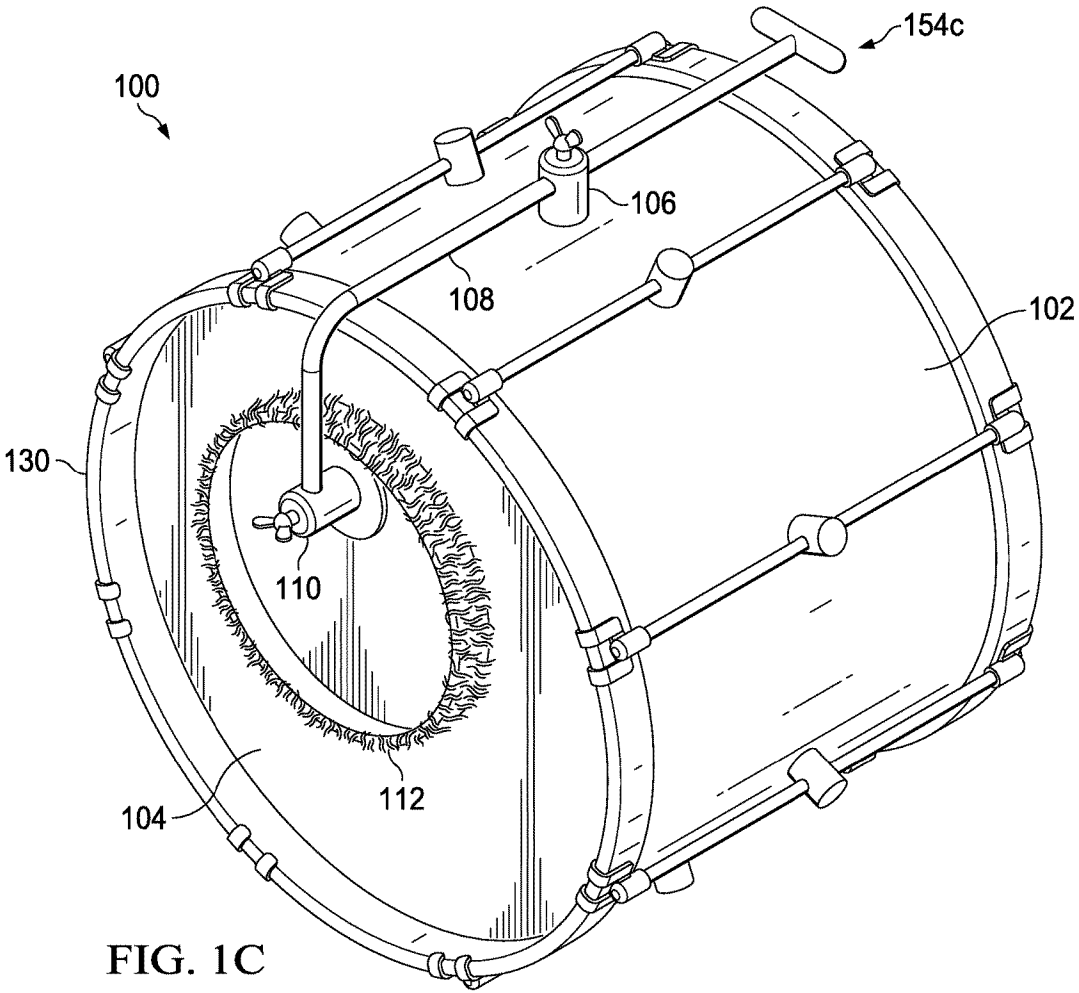
FIG. 1C is a simplified perspective diagram of a drum, in accordance with an embodiment of the present disclosure.

Turning to FIG. 1C, FIG. 1C illustrates when accessory attachment mechanism 110 has been moved towards skin 104. Because accessory 112 is secured to accessory attachment mechanism 110, using support arm 108, accessory attachment mechanism 110 can moved towards skin 104 until accessory 112 is located on or near skin 104. Support arm 108 can include a support arm handle 154*c*. In an example, support arm handle 154*c* can be grasped by a user to help facilitate the movement of support arm across body 102 and accessory attachment mechanism 110 towards and away from skin 104. Support arm handle 154*c* may have a T-shaped profile to allow a user to grasp support arm handle 154*c* during the playing of drum 100.

Using support arm handle 154*c*, accessory attachment mechanism 110 may be moved and/or positioned towards or away from skin 104 in a relatively short period of time (e.g., one second or less, in one beat, etc.). When accessory 112 is located on or near skin 104 and drum 100 is struck, a varied sound can be produced. The term "varied sound" includes a sound that is not a natural sound drum 100 would make if drum 100 did not include any enhancements or an accessory. Using support arm handle 154*a*, 154*b*, 154*c*, or some other means to move support arm 108 across body 102 and accessory attachment mechanism 110 towards and away from skin 104, the distance between accessory 112 and skin 104 can be varied in a relatively short amount of time (e.g., one second or less, in one beat, etc.) to vary the sound of drum 100 when drum 100 is struck. In an illustrative example, while a user is actively playing drum 100, the user may play a few beats on drum 100, vary, in about one second or about one beat, the distance between accessory 112 and skin 104 to vary the sound of drum 100 from the natural sound of drum 100, vary the distance again between accessory 112 and skin 104 to vary the sound of drum 100 to produce a different sound of drum 100, vary the distance yet again between accessory 112 and skin 104 to vary the sound of drum 100 to produce a yet different sound of drum 100, and repeat the process to create a wide variety of sounds from drum 100 in a relatively short period of time. In yet another example, a user may vary the distance between accessory 112 and skin 104 in the middle of a beat to create a unique sound.

It is to be understood that other embodiments may be utilized and structural changes may be made without departing from the scope of the present disclosure. Substantial flexibility is provided by drum 100 in that any suitable arrangements and configuration may be provided without departing from the teachings of the present disclosure. Elements of FIG. 1 may be coupled to one another through one or more attachment means employing any suitable coupling and/or connections. Additionally, any one or more of these elements of FIG. 1 may be combined or removed from the architecture based on particular configuration needs.

For purposes of illustrating certain example techniques of drum 100, the following foundational information may be viewed as a basis from which the present disclosure may be properly explained. End users have different type of drums available to make different type of sounds. However, when a user wants to vary the sound of the drum during playing of the drum, it can be difficult.

A drum, as outlined in FIGS. 1A-1C, can resolve these issues (and others). A drum (e.g., drum 100) can be configured to allow a user to relatively easily enhance or vary the sound of the drum during play of the drum. In an illustrative example, a user can use the drum without an accessory (e.g., accessory 112) to create a natural or original sound from the drum when the drum is struck. When the user wants to vary the sound of the drum, the user can use a support rod (e.g., support arm 108) to move an accessory towards the skin of the drum. When the accessory is on or proximate to the skin of the drum and the drum is struck, the natural or original sound from the drum is varied. When the user wants to return to the natural or original sound of the drum, the support rod can be moved such that the accessory is moved away from the skin of the drum and the drum will return to the natural or original sound when struck. The movement of the accessory towards and away from the skin of the drum can be done relatively quickly (e.g., in one second or less, in one beat, or as quickly as a user can move their hand). This allows a user the ability to create a different variable sound or sounds mid-play when the user is playing the drum. In an example, the accessory can be removed and new accessory can be added to create a different or varied sound when the drum is struck.

Figure 2A:
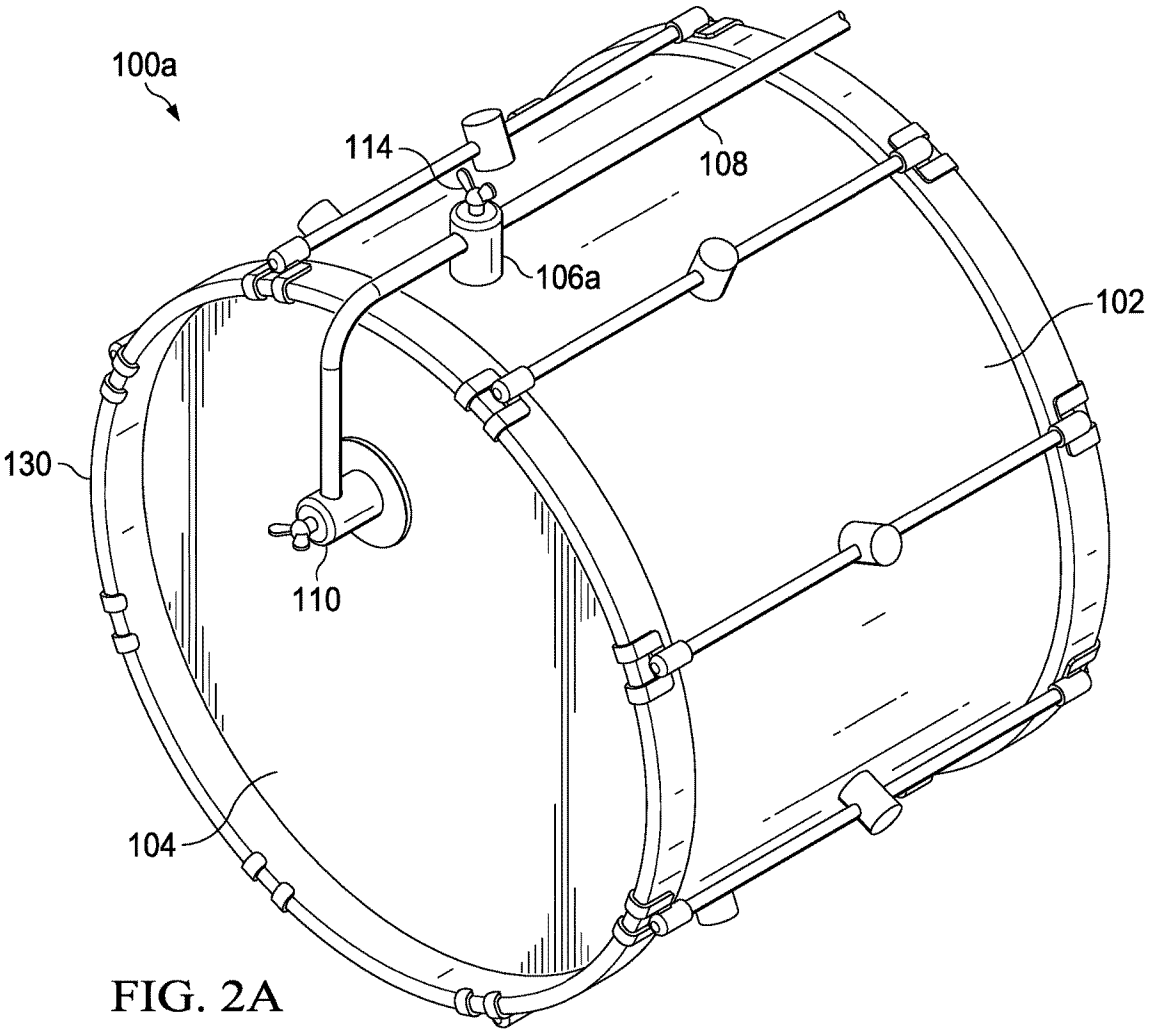
FIG. 2A is a simplified perspective diagram of a drum, in accordance with an embodiment of the present disclosure.

Turning to FIG. 2A, FIG. 2A illustrates an attachment point 106*a* on body 102 of drum 100*a*. As illustrated in FIG. 2A, attachment point 106*a* may be located near one end of drum 100*a* and not in the middle of drum 100*a*. Attachment point 106*a* can include support arm securing mechanism 114. In an illustrative example, support arm securing mechanism 114 may be de-activated and allow support arm 108 to travel back and forth relative to skin 104. Once support arm 108 is at a desired position, support arm securing mechanism 114 may be activated to help hold support arm 108 at the desired position and prevent or restrict support arm 108 from traveling back and forth relative to skin 104. In an example, support arm securing mechanism 114 may be a screw or some other type of securing mechanism that can help secure support arm 108 to attachment point 106*a*. In an illustrative example, if a user is playing drum 100 and desires to move accessory 112 towards skin 104 and/or away from skin 104 during playing of drum 100, then support arm securing mechanism 114 may not be activated to allow support arm 108 to slide back and forth over body 102 of drum 100.

Figure 2B:
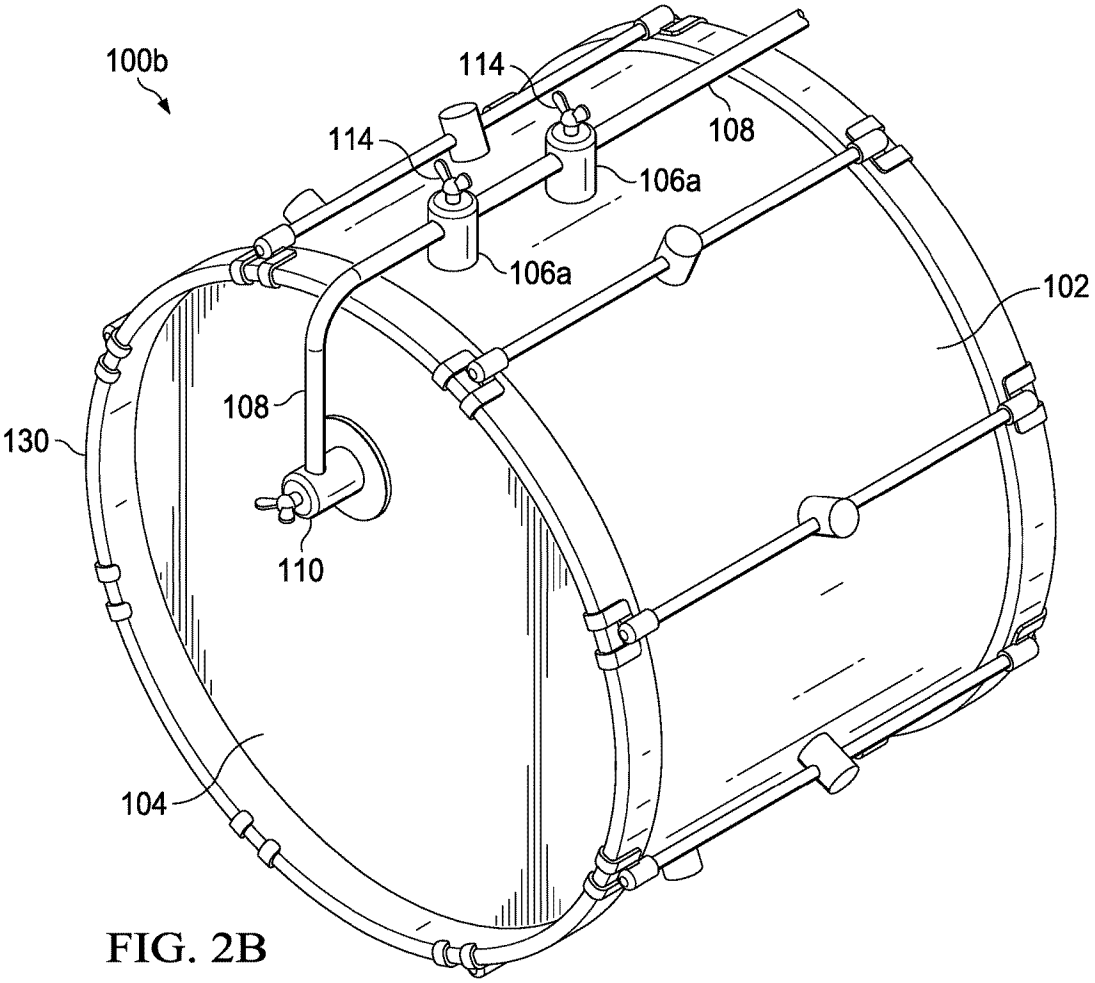
FIG. 2B is a simplified perspective diagram of a drum, in accordance with an embodiment of the present disclosure.

Turning to FIG. 2B, FIG. 2B illustrates a plurality of attachment points 106*a* on body 102 of drum 100*b*. As illustrated in FIG. 2B, a first attachment point 106*a* may be located near one end of drum 100*b* and a second attachment point 106*a* may be located proximate to the middle of drum 100*b*. Each of attachment points 106*a* can include support arm securing mechanism 114. Note that the illustrated location and number of attachment points 106*a* are for example purposes only and more than two attachment points 106*a* may be used and each attachment point 106*a* may be located at any place on drum 100 that would allow for the support of support arm 108. Also, each of attachment points 106*a* may be securely affixed to body 102 and may not be relatively easily removable. In an example, attachment points 106*a* are securely attached to body 102 such that removal of attachment points 106*a* would cause damage to drum 100.

Figure 2C:
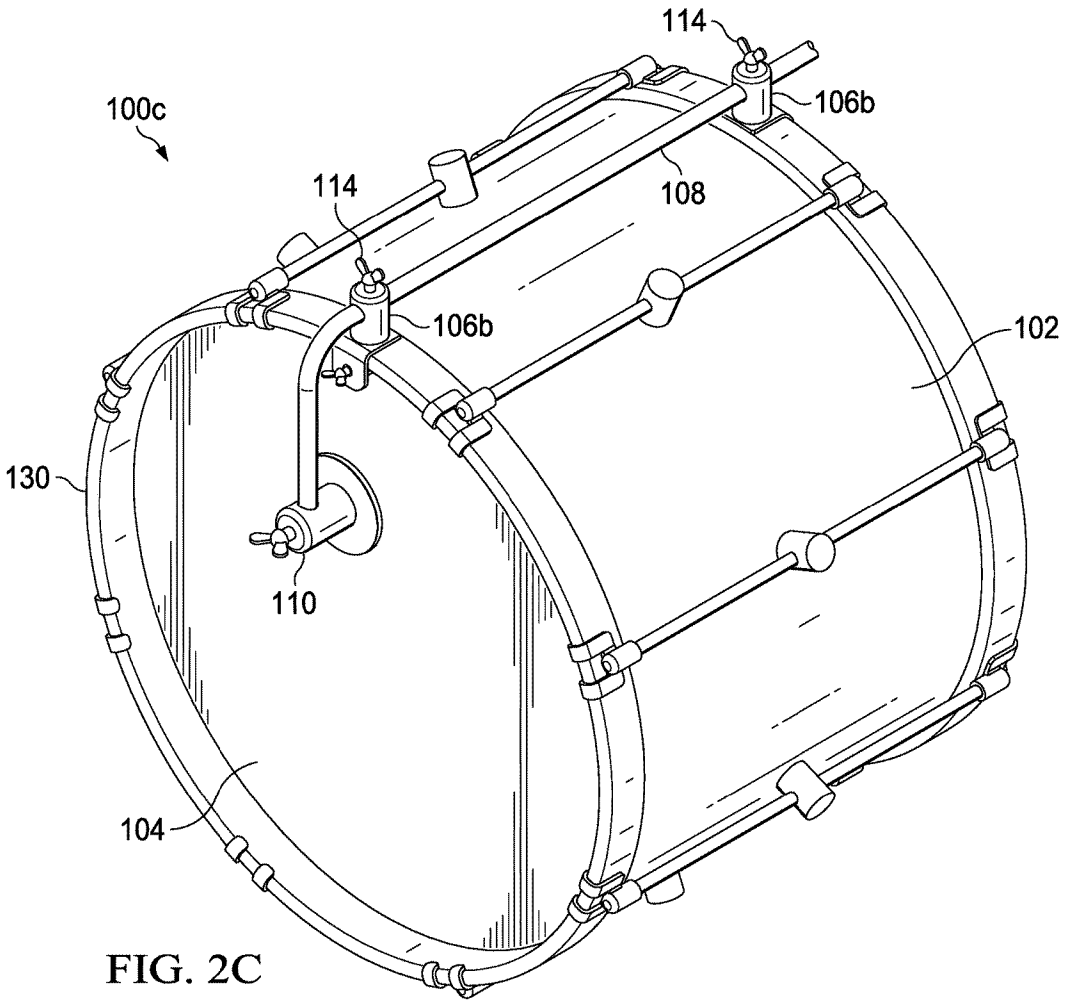
FIG. 2C is a simplified perspective diagram of a drum, in accordance with an embodiment of the present disclosure.

Turning to FIG. 2C, FIG. 2C illustrates a plurality of attachment points 106*b* on rim 130 of drum 103*c*. As illustrated in FIG. 2C, a first attachment point 106*b* may be located on one end of drum 100*c* and a second attachment point 106*b* may be located on the opposite end of drum 100*c*. Each of plurality of attachment points 106*b* may be removable. Each of attachment points 106*a* can include support arm securing mechanism 114.

Figure 3:
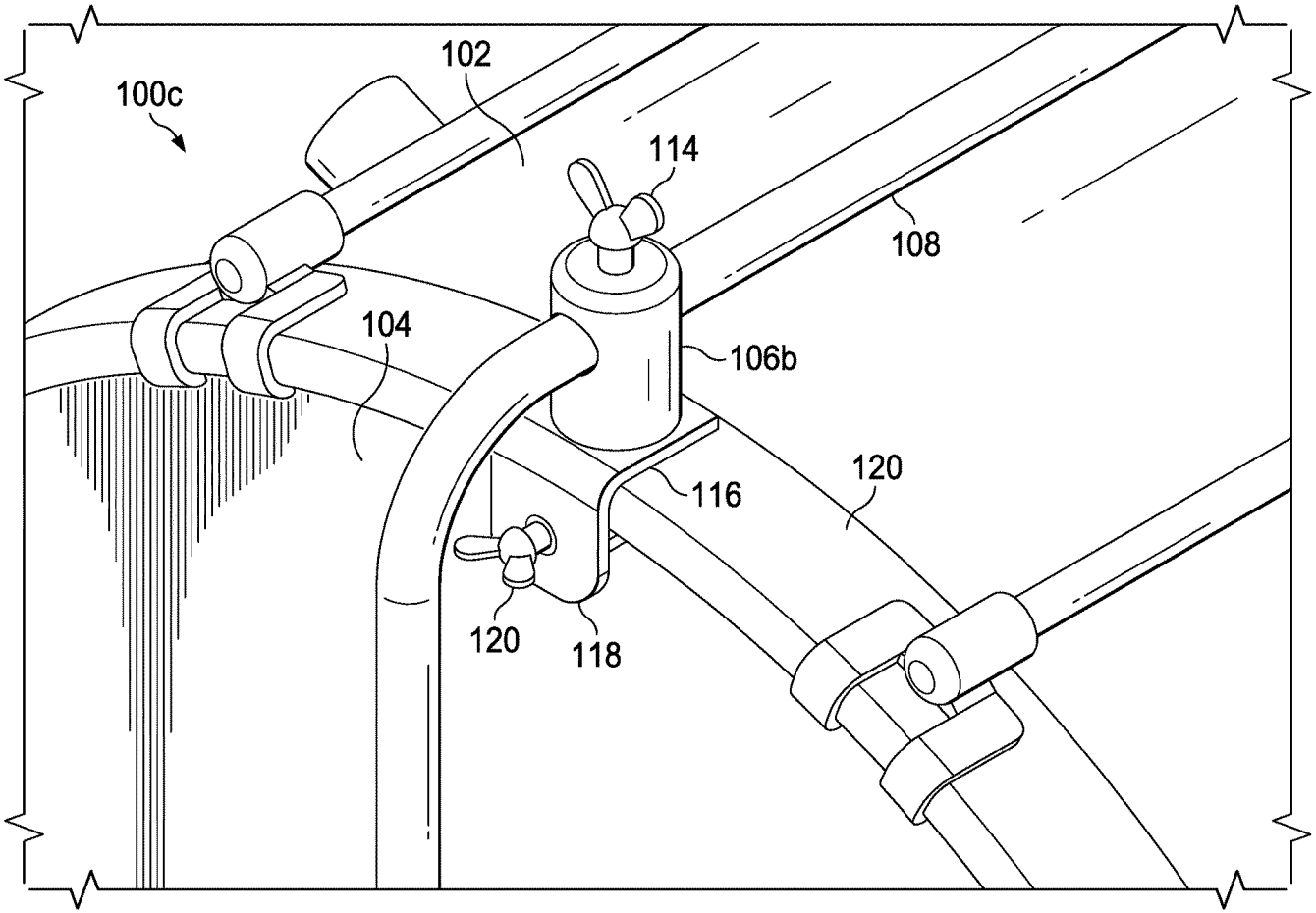
FIG. 3 is a simplified block diagram of a portion of a drum, in accordance with an embodiment of the present disclosure.

Turning to FIG. 3, FIG. 3 is a simplified block diagram illustrating example details of a portion of drum 100, in accordance with an embodiment of the present disclosure. As illustrated in FIG. 3, attachment point 106*b* can be attached to rim 130 of drum 100*c*. Attachment point 106*b* can include a vertical support 116, a horizontal support 118, and an attachment point securing mechanism 120. Vertical support 116 and horizontal support 118 can help support attachment point 106*b* on rim 130. In an illustrative example, attachment point 106*b* can be placed on rim 130 as illustrated in FIG. 3. Attachment point securing mechanism 120 can be activated to secure attachment point 106*b* to rim 130. To remove attachment point 106*b*, attachment point securing mechanism 120 can be deactivated and attachment point 106*b* can be removed from rim 130. In an example, attachment point securing mechanism 120 may be a screw or some other type of securing mechanism that can help secure attachment point 106*b* to rim 130.

Figure 4A:
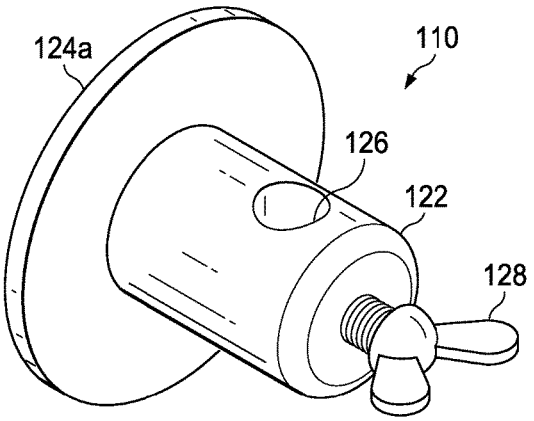
FIG. 4A is a simplified block diagram of a portion of a drum, in accordance with an embodiment of the present disclosure.

Turning to FIG. 4A, FIG. 4A is a simplified block diagram of a portion of drum 100. In an example, accessory attachment mechanism 110 can include an attachment mechanism body 122, an accessory attachment point 124*a*, a support arm conduit 126, and a support arm securing mechanism 128. Accessory attachment point 124*a* can include one or more instances of Velcro®, one or more instances of adhesive, one or more snaps, one or more buttons, one or more push pins, a ball and joint mechanism, one or more button studs, or some other material(s) or mechanism(s) that will allow an accessory (e.g., accessory 112) to be removably attached to accessory attachment point 124*a*.

Figure 4B:
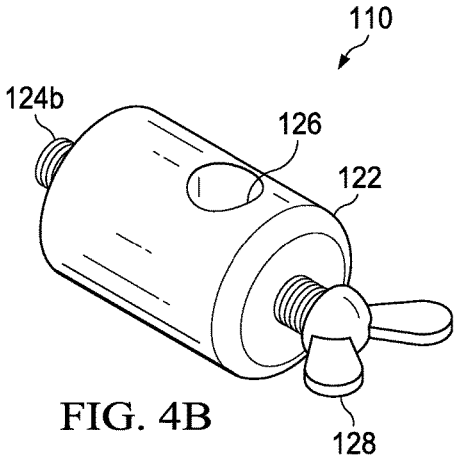
FIG. 4B is a simplified block diagram of a portion of a drum, in accordance with an embodiment of the present disclosure.

Turning to FIG. 4B, FIG. 4B is a simplified block diagram of a portion of drum 100. In an example, accessory attachment mechanism 110 can include attachment mechanism body 122, an accessory attachment point 124*b*, support arm conduit 126, and support arm securing mechanism 128. Accessory attachment point 124*b* can be smaller than the diameter of attachment mechanism body 122 and may be Velcro®, adhesive, a snap, a button, a push pin, ball and joint, button stud, or some other material or mechanism that will allow an accessory (e.g., accessory 112) to be removably attached to accessory attachment point 124*b*.

Figure 5:
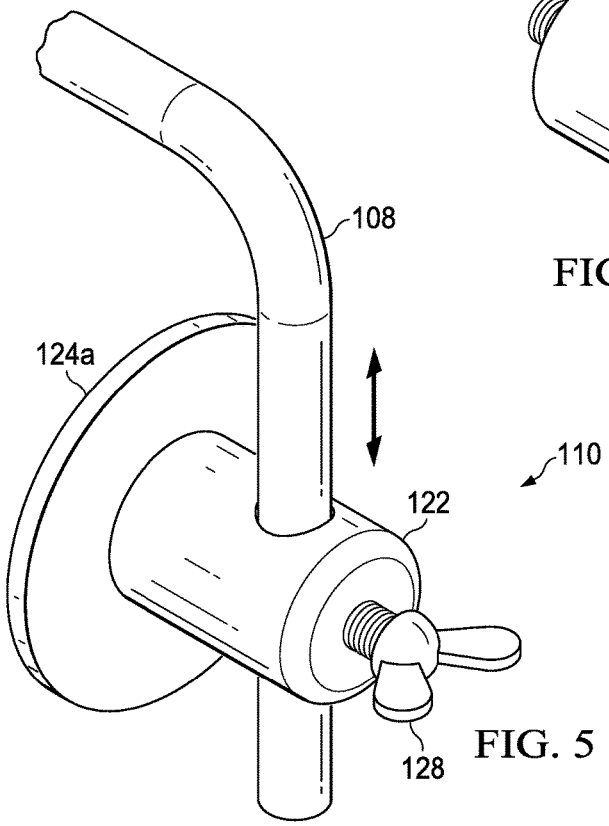
FIG. 5 is a simplified block diagram of a portion of a drum, in accordance with an embodiment of the present disclosure.

Turning to FIG. 5, FIG. 5 is a simplified block diagram illustrating example details of drum 100, in accordance with an embodiment of the present disclosure. As illustrated in FIG. 5, support arm 108 has been inserted through support arm conduit 126. Accessory attachment mechanism 110 can be moved up and down support arm 108. Once accessory attachment mechanism 110 is in a desired location, support arm securing mechanism 128 can be activated to secure accessory attachment mechanism 110 to support arm 108. To remove or change the location of accessory attachment mechanism 110, support arm securing mechanism 128 can be deactivated and accessory attachment mechanism 110 can be removed from support arm 108 or repositioned to a desired location. In an example, support arm securing mechanism 128 may be a screw or some other type of securing mechanism that can help secure accessory attachment mechanism 110 to support arm 108.

Figure 6:
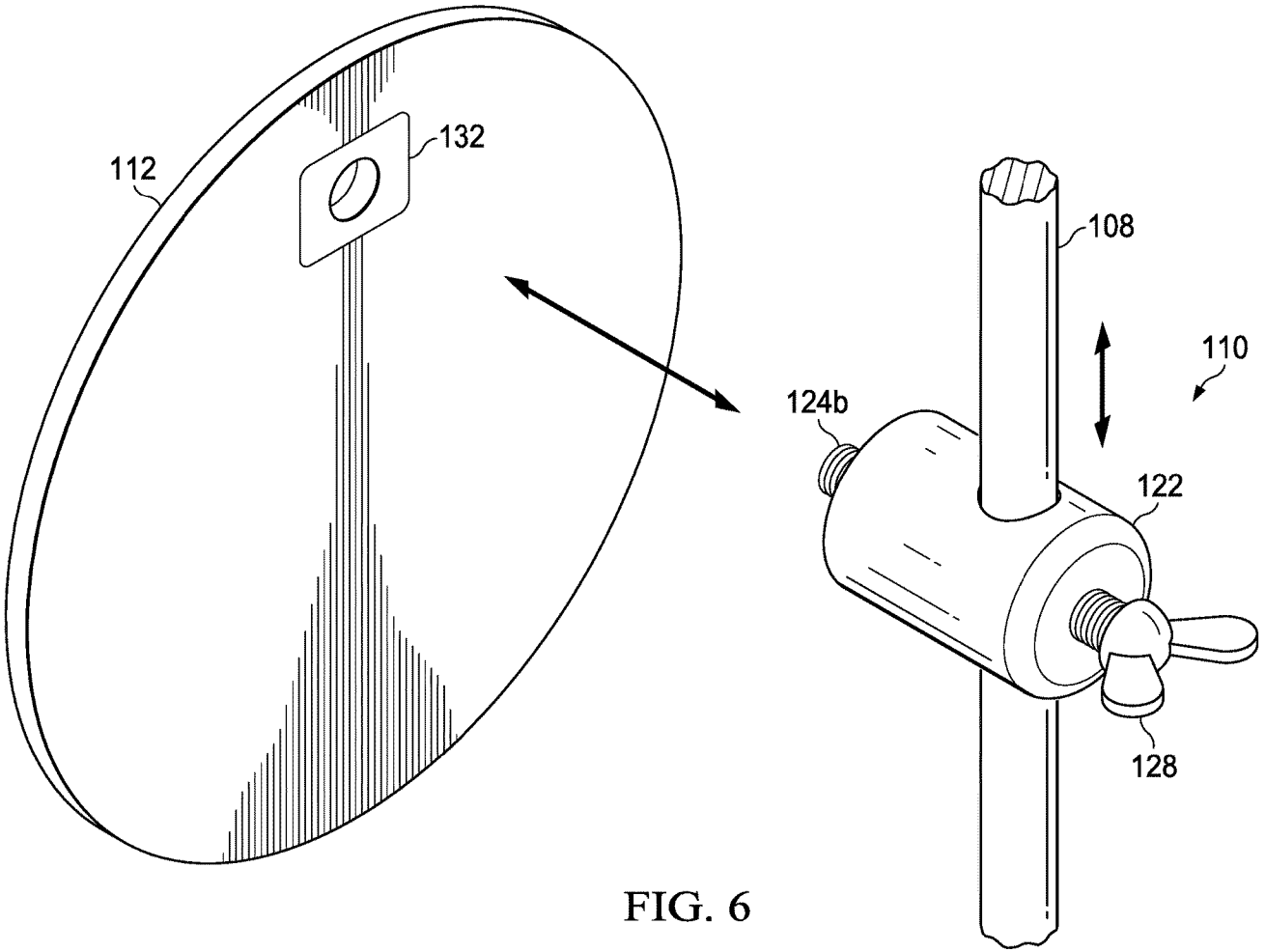
FIG. 6 is a simplified block diagram of a portion of a drum, in accordance with an embodiment of the present disclosure.

Turning to FIG. 6, FIG. 6 is a simplified block diagram illustrating example details of drum 100, in accordance with an embodiment of the present disclosure. As illustrated in FIG. 6, accessory 112 can be removably attached to accessory attachment mechanism 110. In an illustrative example, accessory 112 includes an attachment point 132. Attachment point 132 can couple with accessory attachment point 124*b* (as illustrated), accessory attachment point 124*a*, or some other means or mechanism to removably attach accessory 112 to accessory attachment mechanism 110. Before, after, or while accessory 112 is coupled or is being coupled to accessory attachment mechanism 110, accessory attachment mechanism can be adjusted along support arm 108 such that accessory 112 can be positioned as desired by the user.

Turning to FIGS. 7A-7H, FIGS. 7A-7H are simplified block diagrams illustrating example details of accessory 112, in accordance with an embodiment of the present disclosure. In one example, illustrated in FIG. 7A, accessory 112*a* may include attachment point 132 and a relatively soft outer profile 134. Attachment point 132 can removably couple with accessory attachment point 124 on accessory attachment mechanism 110. Soft outer profile 134 may be a synthetic wool like material or some other material that can dampen the sound of drum 100 when accessory 112*a* is on or proximate to skin 104 and drum 100 is struck. In another example, illustrated in FIG. 7B, accessory 112*b* may include attachment point 132 and a plurality of articles 136. Each of articles 136 may be a bell like article, symbol like article, tambourine, and/or or some other article that makes a sound when accessory 112*b* is on or proximate to skin 104 and drum 100 is struck.

Figure 7A:
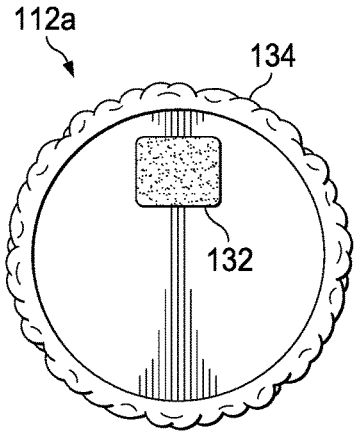
FIG. 7A is a simplified block diagram of an accessory, in accordance with an embodiment of the present disclosure.
Figure 7B:
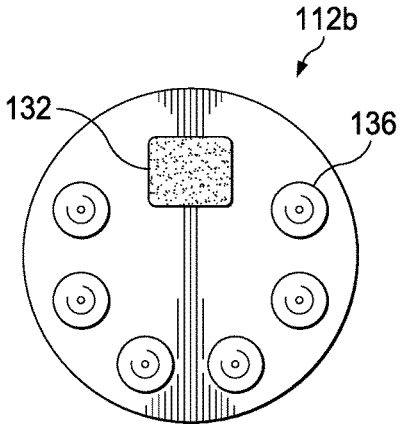
FIG. 7B is a simplified block diagram of a drum, in accordance with an embodiment of the present disclosure.
Figure 7C:
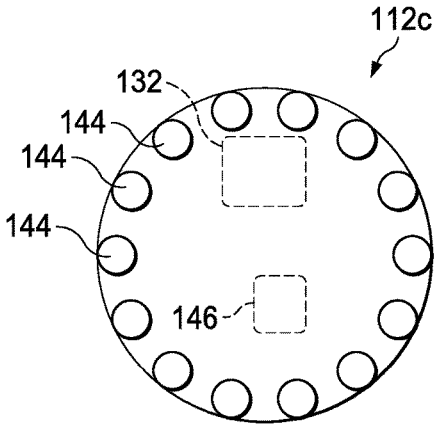
FIG. 7C is a simplified block diagram of a drum, in accordance with an embodiment of the present disclosure.

In yet another example, illustrated in FIG. 7C, accessory 112*c* can include electrical components 144 and electrical circuitry 146. Electrical circuitry 146 can include a power source such as a battery and the electronics (memory, processor, etc.) to help control, activate, power, operation, etc. electrical components 144. In an example, electrical components 144 may be LED lights of one or more colors and the LED lights are activated or respond when drum 100 is struck. As illustrated in FIG. 7C, electrical components 144 may be on the opposite side of accessory 112*c* as the side that includes attachment point 132.

Figure 7D:
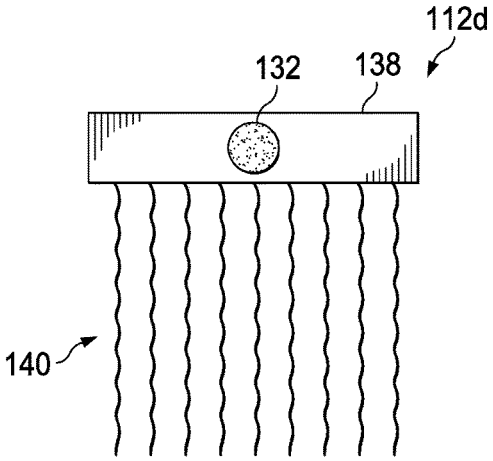
FIG. 7D is a simplified block diagram of a drum, in accordance with an embodiment of the present disclosure.
Figure 7E:
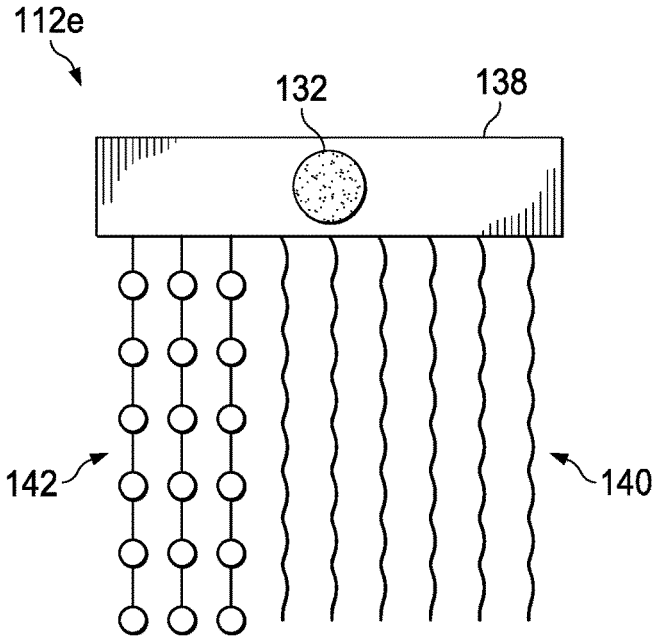
FIG. 7E is a simplified block diagram of an accessory, in accordance with an embodiment of the present disclosure.

In yet another example, illustrated in FIG. 7D, accessory 112*d* may include attachment point 132, support 138, and hanging material 140. Hanging material 140 can be attached to and hang from support 138. Hanging material 140 may be a chain, rope like material, snare wire, or some other material that hangs from support 138 and makes a buzzing or reverberating sound when accessory 112*a* is on or proximate to skin 104 and drum 100 is struck. In yet another example, illustrated in FIG. 7E, accessory 112*e* may include attachment point 132, support 138, hanging material 140, and second hanging material 142. Second hanging material 142 can be attached to and hang from support 138. Second hanging material 142 may be a bead chain, link chain, or some other material that hangs from support 138 and makes a buzzing or reverberating sound when accessory 112*a* is on or proximate to skin 104 and drum 100 is struck.

Figure 7F:
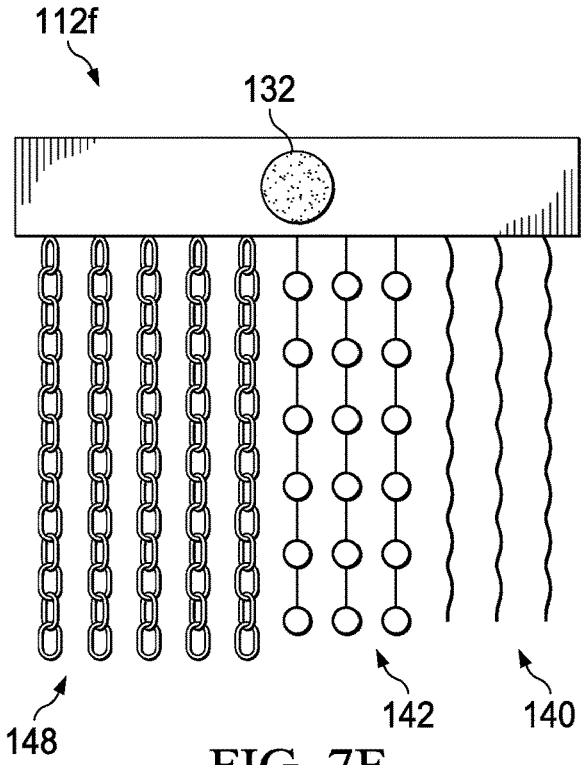
FIG. 7F is a simplified block diagram of a drum, in accordance with an embodiment of the present disclosure.
Figure 7G:
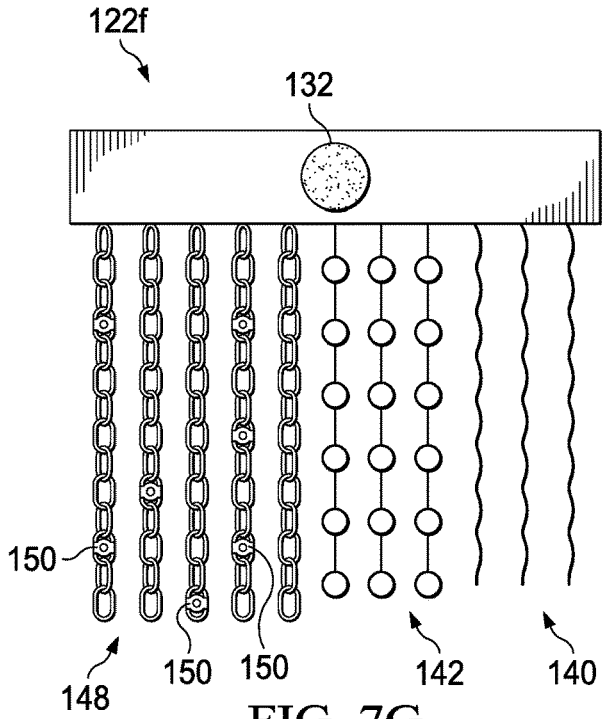
FIG. 7G is a simplified block diagram of a drum, in accordance with an embodiment of the present disclosure.
Figure 7H:
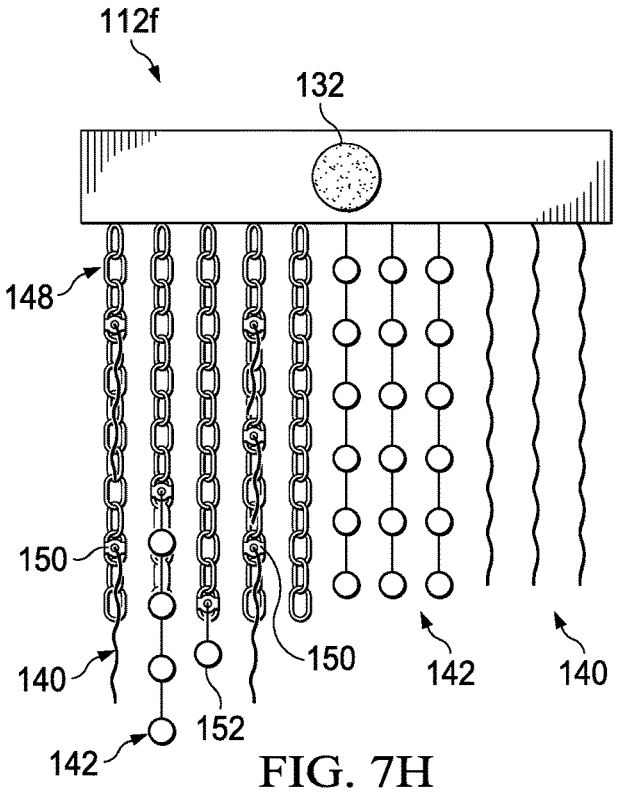
FIG. 7H is a simplified block diagram of a drum, in accordance with an embodiment of the present disclosure.

As illustrated in FIG. 7F, accessory 112*f* may include attachment point 132, support 138, hanging material 140, second hanging material 142, and linked material 148. Linked material 148 can be attached to and hang from support 138. Linked material 148 may be a chain, a material with a plurality of conduits or apertures, or some other material that includes links, holes, conduits, apertures, or cavities, hangs from support 138, and makes a buzzing or reverberating sound when accessory 112*a* is on or proximate to skin 104 and drum 100 is struck. As illustrated in FIG. 7F, one or more connection points 150 can be removably secured to one or more links, holes, conduits, apertures, cavities, etc. in linked material 148. The location and number of each connection point 150 can depend on user preference. As illustrated in FIG. 7H, hanging material 140, second hanging material 142, and/or item 152 can be removably secured to each of one or more connection points 150 to create a different, enhance, or varied sound when the drum 100 is struck. It should be noted that almost any combination of hanging material 140, second hanging material 142, and/or linked material 148 may be used to create a different, enhance, or varied sound when the drum 100 is struck. In addition, accessories 112*a*-112*f* are shown for illustration purposes only and different accessories may be used to create a different, enhance, or varied sound when the drum 100 is struck. For example, an accessory can include a combination of accessory 112*b* illustrated in FIG. 7B and accessory 112*c* illustrated in FIG. 7C.

Figure 8:
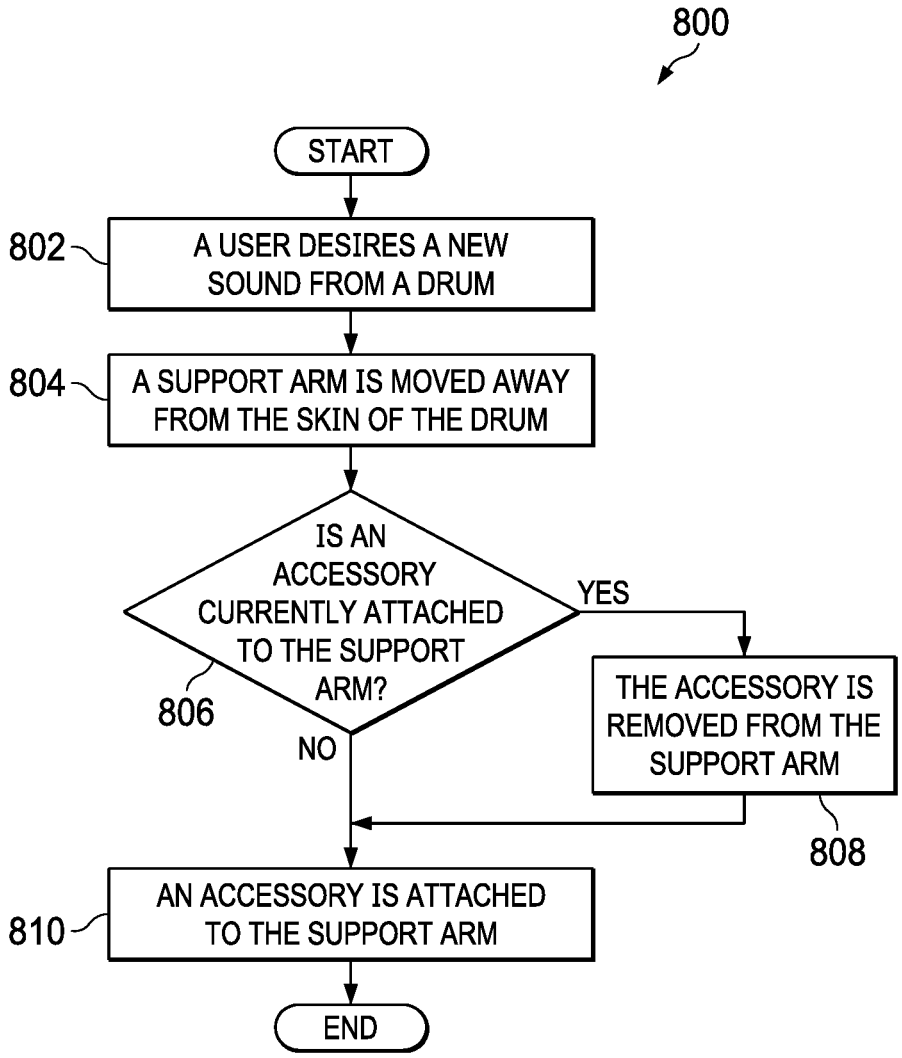
FIG. 8 is a simplified flowchart illustrating potential operations that may be associated with the system in accordance with an embodiment.

Turning to FIG. 8, FIG. 8 is an example flowchart illustrating possible operations of a flow 800 that may be associated with varying the natural sound of a drum, in accordance with an embodiment. At 802, a user desires a new sound from a drum. At 804, a support arm is moved away from the skin of the drum. At 806, the user determines if an accessory is currently attached to the support arm. If an accessory is currently attached to the support arm, then the currently attached accessory is removed, as in 808. If an accessory is not currently attached to the support arm, then an accessory is attached to the support arm to create the new sound from the drum, as in 810. The new sound is created when the user moves the accessory on or proximate to the skin of the drum and plays or strikes the drum.

It is also important to note that the operations in the preceding flow diagrams (i.e., FIG. 8) illustrates only some of the possible correlating scenarios and patterns that may be executed. Some of these operations may be deleted or removed where appropriate, or these operations may be modified or changed considerably without departing from the scope of the present disclosure. In addition, a number of these operations have been described as being executed concurrently with, or in parallel to, one or more additional operations. However, the timing of these operations may be altered considerably. The preceding operational flows have been offered for purposes of example and discussion. Substantial flexibility is provided in that any suitable arrangements, chronologies, configurations, and timing mechanisms may be provided without departing from the teachings of the present disclosure.

Although the present disclosure has been described in detail with reference to particular arrangements and configurations, these example configurations and arrangements may be changed significantly without departing from the scope of the present disclosure. Moreover, certain components may be combined, separated, eliminated, or added based on particular needs and implementations. Additionally, although drum 100 have been illustrated with reference to particular elements and operations that facilitate the varying of the natural sound of a drum using a drum attachment, these elements and operations may be replaced by any suitable architecture, protocols, and/or processes that achieve the intended functionality of drum 100.

Numerous other changes, substitutions, variations, alterations, and modifications may be ascertained to one skilled in the art and it is intended that the present disclosure encompass all such changes, substitutions, variations, alterations, and modifications as falling within the scope of the appended claims. In order to assist the United States Patent and Trademark Office (USPTO) and, additionally, any readers of any patent issued on this application in interpreting the claims appended hereto, Applicant wishes to note that the Applicant: (a) does not intend any of the appended claims to invoke paragraph six (6) of 35 U.S.C. section 112 as it exists on the date of the filing hereof unless the words "means for" or "step for" are specifically used in the particular claims; and (b) does not intend, by any statement in the specification, to limit this disclosure in any way that is not otherwise reflected in the appended claims.

Other Notes and Examples

Example A1 is an apparatus including a body, a skin, an attachment point, a support arm that can travel back and forth through the attachment point, and an accessory, wherein when the accessory is positioned on or proximate to the skin, a natural sound of the drum is varied when the drum is struck. In an example, the apparatus is a drum.

In Example A2, the subject matter of Example A1 can optionally include where the attachment point is located on the body of the drum.

In Example A3, the subject matter of any of the Examples A1-A2 can optionally include where a plurality of attachment points are located on the body of the drum.

In Example A4, the subject matter of any of the Examples A1-A3 can optionally include where the attachment point is located on a rim of the drum.

In Example A5, the subject matter of any of the Examples A1-A4 can optionally include where the attachment point is removable.

In Example A6, the subject matter of any of the Examples A1-A5 can optionally include where the accessory is removable and can be replaced with a different accessory that will cause a different sound to be produced when the different accessory is positioned on or proximate to the skin and the drum is struck.

Example M1 is a method including positioning an accessory on a support arm of a drum, where the drum includes a body, a skin, and an attachment point, where the support arm that can travel back and forth through the attachment point and the method includes using the support arm to position the accessory on or proximate to the skin to vary a natural sound of the drum when the drum is struck.

In Example M2, the subject matter of Example M1 can optionally include using the support arm to position the accessory away from the skin so the drum produces the natural sound of the drum when the drum is struck.

In Example M3, the subject matter of any of the Examples M1-M2 can optionally include removing the accessory from the support arm, adding a new accessory to the support arm, and using the support arm to position the new accessory on or proximate to the skin to vary a natural sound of the drum when the drum is struck.

In Example M4, the subject matter of any of the Examples M1-M3 can optionally include where the attachment point is located on the body of the drum.

In Example M5, the subject matter of any of the Examples M1-M4 can optionally include where a plurality of attachment points are located on the body of the drum.

In Example M6, the subject matter of any of the Examples M1-M5 can optionally include where the attachment point is located on a rim of the drum.

In Example M7, the subject matter of any of the Examples M1-M6 can optionally include where the drum is a base drum.

In Example M8, the subject matter of any of the Examples M1-M7 can optionally include where the accessory can be moved towards the skin in less than one second.

In Example S1, a system for changing a natural sound of a drum can include an accessory, a support arm, and an attachment point. The attachment point is located on a drum that includes a body, a rim, and a skin, where the support arm can travel back and forth through the attachment point, where the accessory is attached to the support arm and when the accessory is positioned on or proximate to the skin, a natural sound of the drum is varied when the drum is struck.

In Example, S2, the subject matter of Example S1 can optionally include where the accessory is removable from the support arm.

In Example S3, the subject matter of any one of Examples S1-S2 can optionally include where the accessory is removable from the support arm and can be replaced with a different accessory that will cause a different sound to be produced when the different accessory is positioned on or proximate to the skin and the drum is struck.

In Example S4, the subject matter of any one of Examples S1-S3 can optionally include where the attachment point is located on the body of the drum.

In Example S5, the subject matter of any one of Examples S1-S4 can optionally include where a plurality of attachment points are located on the body of the drum.

In Example S6, the subject matter of any one of Examples S1-S5 can optionally include where the attachment point is located on a rim of the drum.

What is claimed is:

1. A drum comprising:

a body, wherein the body includes an outside portion and a proximate middle portion;

a skin, wherein the skin includes an outside skin portion;

an attachment point located on the outside portion of the body;

a support arm that can travel back and forth through the attachment point and extends over the outside portion of the body from the skin to at least the proximate middle portion; and an accessory removably attached to the support arm, wherein when the accessory is positioned on or proximate to the outside skin portion, a natural sound of the drum is varied when the drum is struck.

2. The drum of claim 1, wherein a plurality of attachment points are located on the body of the drum.

3. The drum of claim 1, wherein the attachment point is located on a rim of the drum.

4. The drum of claim 1, wherein the attachment point is removable.

5. The drum of claim 1, wherein the accessory is removable and can be replaced with a different accessory that will cause a different sound to be produced when the different accessory is positioned on or proximate to the skin and the drum is struck.

6. A method comprising:

positioning an accessory on a support arm of a drum, wherein the drum includes:

a body, wherein the body includes an outside portion and a proximate middle portion;

a skin, wherein the skin includes an outside skin portion; and an attachment point located on the outside portion of the body, wherein the support arm extends over the outside portion of the body from the skin to at least the proximate middle portion and can travel back and forth through the attachment point; and using the support arm to position the accessory on or proximate to the outside skin portion to vary a natural sound of the drum when the drum is struck.

7. The method of claim 6, further comprising:

during playing of the drum, using the support arm to position the accessory away from the skin so the drum produces the natural sound of the drum when the drum is struck.

8. The method of claim 6, further comprising:

removing the accessory from the support arm;

adding a new accessory to the support arm; and using the support arm to position the new accessory on or proximate to the skin to vary a natural sound of the drum when the drum is struck.

9. The method of claim 6, wherein the attachment point is located at the proximate middle portion of the body of the drum.

10. The method of claim 6, wherein a plurality of attachment points are located on the body of the drum.

11. The method of claim 6, wherein the attachment point is located on a rim of the drum.

12. The method of claim 6, wherein the drum is a base drum.

13. The method of claim 6, wherein the accessory can be moved towards the skin in less than one second.

14. A system for changing a natural sound of a drum, the system comprising:

an accessory;

a support arm; and an attachment point, wherein the attachment point is located on a drum that includes a body, wherein the body includes an outside portion and a proximate middle portion, a rim, and a skin, wherein the skin includes an outside skin portion, wherein the support arm can travel back and forth through the attachment point located on the outside portion of the body, wherein the accessory is removably attached to the support arm and when the accessory is positioned on or proximate to the outside skin portion, a natural sound of the drum is varied when the drum is struck.

15. The system of claim 14, wherein the accessory is removable from the support arm.

16. The system of claim 14, wherein the accessory is removable from the support arm and can be replaced with a different accessory that will cause a different sound to be produced when the different accessory is positioned on or proximate to the skin and the drum is struck.

17. The system of claim 14, wherein the attachment point is located at the proximate middle portion of the body of the drum.

18. The system of claim 14, wherein a plurality of attachment points are located on the body of the drum.

19. The system of claim 14, wherein the attachment point is located on a rim of the drum.

20. The drum of claim 1, wherein the accessory can be moved away from the skin during playing of the drum and moved back on or proximate to the skin during playing of the drum.

* * * * *